US009210959B1

(12) United States Patent
Jankowski

(10) Patent No.: US 9,210,959 B1
(45) Date of Patent: Dec. 15, 2015

(54) SELECTIVELY DECORATIVE CLOTHING ARTICLE

(71) Applicant: DIAMOND DUST DESIGN LLC, Lannon, WI (US)

(72) Inventor: Tamara L. Jankowski, Lannon, WI (US)

(73) Assignee: Diamond Dust Design LLC, Lannon, WI (US)

( * ) Notice: Subject to any disclaimer, the term of this patent is extended or adjusted under 35 U.S.C. 154(b) by 0 days.

(21) Appl. No.: 14/532,516

(22) Filed: Nov. 4, 2014

Related U.S. Application Data

(60) Provisional application No. 62/043,249, filed on Aug. 28, 2014.

(51) Int. Cl.

| | |
|---|---|
| ***A41D 27/08*** | (2006.01) |
| ***A43B 3/16*** | (2006.01) |
| ***A43B 3/18*** | (2006.01) |
| ***A41D 17/00*** | (2006.01) |
| ***A43C 11/24*** | (2006.01) |

(52) U.S. Cl.
CPC ..... *A41D 27/08* (2013.01); *A41D 17/00* (2013.01); *A43B 3/16* (2013.01); *A43B 3/18* (2013.01); *A43C 11/24* (2013.01)

(58) Field of Classification Search
CPC ..... A43B 23/24; A43B 3/0078; A43B 3/242; A43B 7/20; A43B 3/02; A43B 3/16; A43B 5/18; A43B 3/20; A43B 3/24; A43B 23/06; A43B 7/34; A43B 3/163; A43B 3/18; A43B 7/12; A43B 1/00; A43B 5/02; A43B 11/00; A43B 1/0054; A43B 1/0081; A43B 5/0415; A43B 5/1666; A43B 5/1691; A41D 17/00; A41D 27/08; A41D 13/0562; A41D 17/005; A41D 17/02; A41D 1/067; A44C 13/00; A44C 15/00; A44C 15/009; A44C 5/102; A44C 5/2042; A44C 5/2076; A44B 17/0082; A44B 11/06; A44B 17/0023; A44B 17/0064; A44B 18/00; A44B 1/123; A43C 11/14; A43C 11/1493; A43C 11/22; A43C 11/24
See application file for complete search history.

(56) References Cited

U.S. PATENT DOCUMENTS

| | | | | | |
|---|---|---|---|---|---|
| 1,712,035 | A | * | 5/1929 | Frykman | 36/1.5 |
| 2,028,947 | A | * | 1/1936 | Palm | 36/2 R |
| 2,291,791 | A | * | 8/1942 | Casserd | 36/8.3 |
| 2,420,618 | A | * | 5/1947 | Rabinovitz | 36/2 R |
| 2,729,899 | A | * | 1/1956 | Haase | 36/7.1 R |
| 3,087,260 | A | * | 4/1963 | Hudon | 36/7.2 |
| 4,384,413 | A | * | 5/1983 | Bourque | 36/115 |
| 4,503,566 | A | * | 3/1985 | Wheeler | 2/22 |
| 4,771,553 | A | * | 9/1988 | Smithdeal | 36/1 |

(Continued)

OTHER PUBLICATIONS

"Leather Legs", The Ideal Alternative to Hot and Bulky Chaps!, date unknown (printed on Dec. 2, 2014, 6 pages).

*Primary Examiner* — Bobby Muromoto, Jr.
(74) *Attorney, Agent, or Firm* — Ryan Kromholz & Manion, S.C.

(57) ABSTRACT

Selectively decorative clothing articles are provided with one or more anchor points for removably coupling decorative elements thereto. Anchor points include a throughhole and may be reinforced with a grommet. A fastener may be inserted into and supported within the throughhole and/or grommet. The fastener may be two pieces threadably engaged and providing a receiving aperture configured to receive a coupling member such as a jeweler's clip.

20 Claims, 12 Drawing Sheets

(56) References Cited

U.S. PATENT DOCUMENTS

| | | | | | |
|---|---|---|---|---|---|
| 4,899,556 | A * | 2/1990 | Ford | 63/14.1 |
| 5,062,223 | A * | 11/1991 | Johnson | 36/7.1 R |
| 5,251,386 | A * | 10/1993 | Diaz | 36/2 R |
| 5,272,822 | A * | 12/1993 | Diaz | 36/2 R |
| 5,325,542 | A * | 7/1994 | Lenerville | 2/244 |
| 5,501,022 | A * | 3/1996 | Cohn | 36/2 R |
| 5,694,703 | A * | 12/1997 | Diaz | 36/7.1 R |
| D388,600 | S * | 1/1998 | Staley, Jr. | D2/980 |
| 5,713,080 | A * | 2/1998 | Tate | 2/80 |
| 5,740,559 | A * | 4/1998 | Thiel | 2/239 |
| 5,773,118 | A * | 6/1998 | Eisenpresser | 428/79 |
| 5,784,806 | A * | 7/1998 | Wendt | 36/2 R |
| 5,787,607 | A * | 8/1998 | Schurch | 36/7.1 R |
| 5,956,867 | A * | 9/1999 | Harton | 36/7.1 R |
| D434,555 | S * | 12/2000 | James | D2/986 |
| 6,216,279 | B1 * | 4/2001 | Ellingson | 2/239 |
| 6,594,920 | B2 * | 7/2003 | Pizzamiglio et al. | 36/117.6 |
| D556,441 | S * | 12/2007 | Athouriste | D2/976 |
| 7,328,528 | B2 * | 2/2008 | Caminiti | 36/136 |
| 7,721,571 | B2 * | 5/2010 | Rose et al. | 63/33 |
| 7,819,721 | B1 * | 10/2010 | Messier | 450/86 |
| 7,908,771 | B2 * | 3/2011 | Foxen et al. | 36/89 |
| 8,001,705 | B2 * | 8/2011 | Cagliari | 36/117.1 |
| 8,001,706 | B2 * | 8/2011 | Jeffers et al. | 36/136 |
| 8,099,881 | B2 * | 1/2012 | Yamamoto | 36/45 |
| 8,113,013 | B2 * | 2/2012 | Kessler | 63/40 |
| 8,453,267 | B1 * | 6/2013 | Stanley | 2/244 |
| 8,683,715 | B1 * | 4/2014 | Cantrell et al. | 36/2 R |
| 8,689,469 | B2 * | 4/2014 | Foxen et al. | 36/89 |
| 8,701,311 | B2 * | 4/2014 | Barnhart | 36/136 |
| 2005/0235522 | A1 * | 10/2005 | Crowley et al. | 36/2 R |
| 2005/0278976 | A1 * | 12/2005 | Bry | 36/1 |
| 2006/0010575 | A1 * | 1/2006 | Heiderer et al. | 2/239 |
| 2007/0084080 | A1 * | 4/2007 | Heiderer et al. | 36/2 R |
| 2007/0214681 | A1 * | 9/2007 | Dezfouli | 36/101 |
| 2008/0163516 | A1 * | 7/2008 | Camarillo | 36/136 |
| 2009/0034237 | A1 * | 2/2009 | Peckham, Jr. | 362/103 |
| 2009/0071037 | A1 * | 3/2009 | Foxen et al. | 36/89 |
| 2009/0119946 | A1 * | 5/2009 | Baker | 36/7.2 |
| 2009/0158621 | A1 * | 6/2009 | Yamamoto | 36/98 |
| 2009/0188020 | A1 * | 7/2009 | Beaumont | 2/239 |
| 2009/0241380 | A1 * | 10/2009 | Jeffers et al. | 36/136 |
| 2009/0265960 | A1 * | 10/2009 | Parrott | 36/136 |
| 2010/0064551 | A1 * | 3/2010 | Aldridge | 36/2 R |
| 2010/0186258 | A1 * | 7/2010 | Garza | 36/101 |
| 2011/0131837 | A1 * | 6/2011 | Foxen et al. | 36/89 |
| 2011/0162237 | A1 * | 7/2011 | Jeffers et al. | 36/136 |
| 2011/0239487 | A1 * | 10/2011 | Renkes | 36/136 |
| 2011/0258874 | A1 * | 10/2011 | Riddleberger | 36/7.1 R |
| 2011/0308110 | A1 * | 12/2011 | Berns et al. | 36/89 |
| 2011/0308111 | A1 * | 12/2011 | Paraszczak et al. | 36/100 |
| 2012/0047773 | A1 * | 3/2012 | Schrader | 36/136 |
| 2012/0174442 | A1 * | 7/2012 | Castle | 36/136 |
| 2013/0014408 | A1 * | 1/2013 | Neilson | 36/101 |
| 2013/0133228 | A1 * | 5/2013 | Nugent | 36/109 |
| 2013/0199020 | A1 * | 8/2013 | Frydlewski et al. | 29/525.01 |
| 2013/0263625 | A1 * | 10/2013 | Taylor-Cattapan | 63/4 |
| 2013/0291588 | A1 * | 11/2013 | Babyak | 63/29.1 |
| 2013/0327088 | A1 * | 12/2013 | Smith | 63/15 |
| 2014/0011421 | A1 * | 1/2014 | Martinez et al. | 446/73 |
| 2014/0041260 | A1 * | 2/2014 | Jewell et al. | 36/2 R |
| 2014/0082974 | A1 * | 3/2014 | Rucker | 36/72 R |
| 2014/0109437 | A1 * | 4/2014 | Burr | 36/7.1 R |
| 2014/0193297 | A1 * | 7/2014 | Ferman | 422/5 |
| 2014/0208617 | A1 * | 7/2014 | Foxen et al. | 36/89 |
| 2014/0223639 | A1 * | 8/2014 | Betrus | 2/245 |
| 2014/0230279 | A1 * | 8/2014 | Risner | 36/101 |
| 2014/0245792 | A1 * | 9/2014 | Kienzle et al. | 63/14.4 |
| 2014/0259763 | A1 * | 9/2014 | Rady | 36/58.5 |
| 2014/0360228 | A1 * | 12/2014 | Cochrane | 63/11 |
| 2014/0363227 | A1 * | 12/2014 | Ho | 403/376 |
| 2015/0096328 | A1 * | 4/2015 | Schwartz | 63/1.13 |

* cited by examiner

SELECTIVELY DECORATIVE CLOTHING ARTICLE

RELATED APPLICATIONS

This application claims the benefit of co-pending U.S. Provisional Patent Application Ser. No. 62/043,249, entitled, "Selectively Decorative Clothing Article," and filed on 28 Aug. 2014.

BACKGROUND OF THE INVENTION

The present invention relates generally to clothing, and more particularly to clothing articles that may be selectively decorated.

Prior systems and methods relating to clothing decoration are known. However, most prior systems and methods involve permanent fastening of decorative elements, such as faux jewels, to a clothing article. This fastening is deemed permanent, because the decorative elements would need to be destroyed beyond a point of reuse in order to be removed from a clothing article. However, there are situations in which it may be desirable to decorate a clothing article in different ways for different occasions, or for a limited period of time, or even in different decorative configurations during the same wearing time.

Accordingly, the art of clothing decoration would be improved by systems and methods related to temporary or easily reconfigurable decoration.

SUMMARY OF THE INVENTION

Embodiments of systems and methods according to the present invention provide selective decoration of a clothing article.

A decorative clothing article according to the present invention may include a left panel having a left panel top end, a left panel front side, and a left panel rear side; a right panel having a right panel top end, a right panel front side, and a right panel rear side; and a top panel having a top panel top end and a top panel bottom end. The left panel front side is preferably attached to the right panel front side and the left panel rear side is attached to the right panel rear side, and the top panel bottom end is preferably attached to the left panel top end and the right panel top end. A fastening member is attached to at least one of the left and right panels; an anchor point is located in at least one of the left panel, the right panel, and the top panel; and a fastener comprising a fastener back member reversibly connectable to a fastener front member is configured to be received within the anchor point.

According to an aspect of a decorative clothing article according to the present invention, the left and right panels may be substantially identical.

According to another aspect of a decorative clothing article according to the present invention, the fastening member may be a strap. The fastening member may also be a zipper.

The decorative clothing article may also have a knee cap panel with a knee cap panel bottom end, whereby the knee cap panel bottom end is attached to the top panel top end. The knee cap may also have an anchor point, whereby the anchor point in the knee cap panel is alignable with an anchor point in the top panel, and whereby the knee cap panel is selectively attachable to the top panel by the fastener received within the knee cap panel anchor point and the top panel anchor point.

According to yet another aspect of the decorative clothing article of the present invention, the fastener front member may include a receiving aperture, and further, a decorative element may be selectively supportable by the receiving aperture of the fastener front member.

The decorative clothing article may also include a shin wrap panel having at least two anchor points, whereby the shin wrap panel is selectively supportable by the top panel and the anchor points in the shin wrap panel are alignable with the anchor points in the top panel wherein fasteners are received therethrough. The shin wrap panel and the top panel may be substantially similar in shape. The shin wrap panel may also be a different color and/or a different material than the top panel, and may include indicia.

A kit comprising elements of a decorative clothing article according to the present invention may include a tray having a cavity to retain the elements of a decorative clothing article; the elements of a decorative clothing article comprising at least one of a clothing article, a knee cap panel, a decorative element, a fastening member, a fastener, and instructions. The clothing article may comprise a left panel having a left panel top end, a left panel front side, and a left panel rear side; a right panel having a right panel top end, a right panel front side, and a right panel rear side; a top panel having a top panel bottom end and a top panel top end; whereby the left panel front side is attached to the right panel front side and the left panel rear side is attached to the right panel rear side; the top panel bottom end is attached to the left panel top end and the right panel top end; and including an anchor point in at least one of the left panel, the right panel, and the top panel.

Another aspect of the kit according to the present invention provides that the right and left have an anchor point and includes a heel strap having a pair of anchors alignable with the anchors in the right and left panels. The kit may further include a plurality of fastening members of various lengths.

The kit may also provide the top panel with an anchor point and further include a shin wrap panel, the shin wrap panel having at least two anchor points, whereby the anchor points in the shin wrap panel are alignable with anchor points in the top panel.

The fastener provided in the kit may have a back member reversibly connectable to a front member, whereby the front member has a receiving aperture.

A method of coupling a decorative element to an anchor point on a clothing article may include the steps of: providing a clothing article with a left panel having a left panel top end, a left panel front side, and a left panel rear side; a right panel having a right panel top end, a right panel front side, and a right panel rear side; a top panel having a top panel bottom end and a top panel top end; whereby the left panel front side may be attached to the right panel front side and the left panel rear side may be attached to the right panel rear side; the top panel bottom end may be attached to the left panel top end and the right panel top end; a fastening member may be attached to at least one of the left and right panels; and an anchor point may be provided in at least one of the left panel, the right panel, and the top panel; providing a plurality of fasteners, each fastener having a receiving aperture; providing a decorative element with a jeweler's hook; receiving one of the plurality of fasteners within the anchor point; and coupling the jeweler's hook with the receiving aperture of the fastener.

Another aspect of the method of coupling a decorative element to an anchor point on a clothing article according to the present invention may further include the steps of: providing a strap with an anchor point; aligning the anchor point of the clothing article and the anchor point of the strap; and receiving one of the plurality of fasteners within the anchor points.

Yet another aspect of the method of coupling a decorative element to an anchor point on a clothing article according to the present invention may further include the steps of: providing a shin wrap panel with at least two anchor points; aligning the anchor points of the clothing article and the anchor points of the shin wrap panel; and receiving one of the plurality of fasteners within the anchor points.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1A:
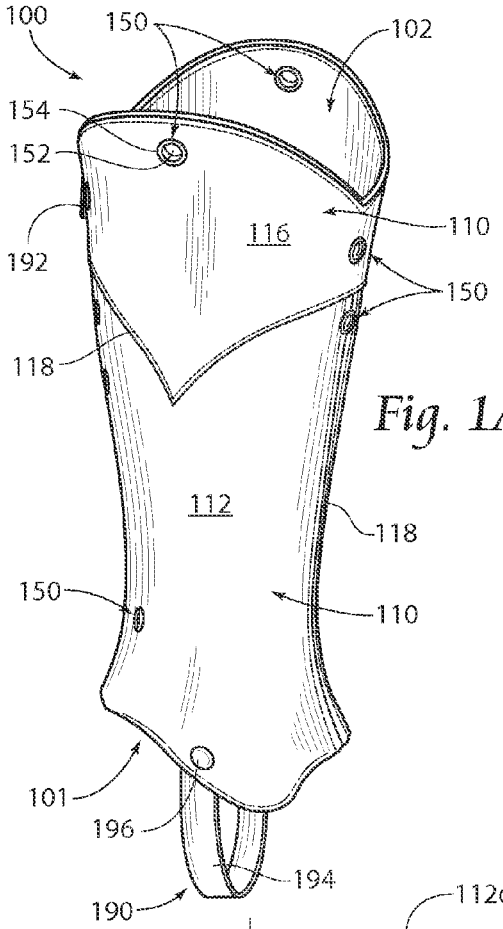
FIG. 1A is a perspective view of a first embodiment of selectively decorative clothing according to the present invention.
Figure 1B:
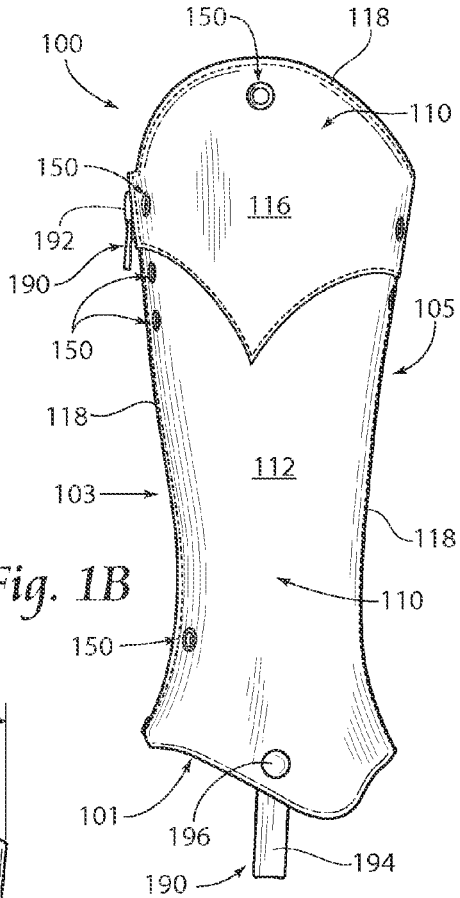
FIG. 1B is a left side elevation view of the embodiment of FIG. 1.

Turning now to the figures, FIGS. 1A and 1B depict a first embodiment 100 of a selectively decorative clothing article according to the present invention. Generally, clothing articles according to this present invention include one or more structural panels 110 and at least one, but preferably a plurality of anchor points 150. Clothing articles according to the present invention may further include fastening members 190, configured to maintain a position of the article on an animal body, such as a human body. Examples of suitable fastening members 190 may be a zipper 192, a strap 194 with one or more snaps 196, or even laces, hook-and-loop material, snaps, toggles, or the like.

The panels 110 are preferably formed from a flexible woven or nonwoven material, such as vinyl, leather, cloth, latex, and/or neoprene, for example.

Figure 2A:
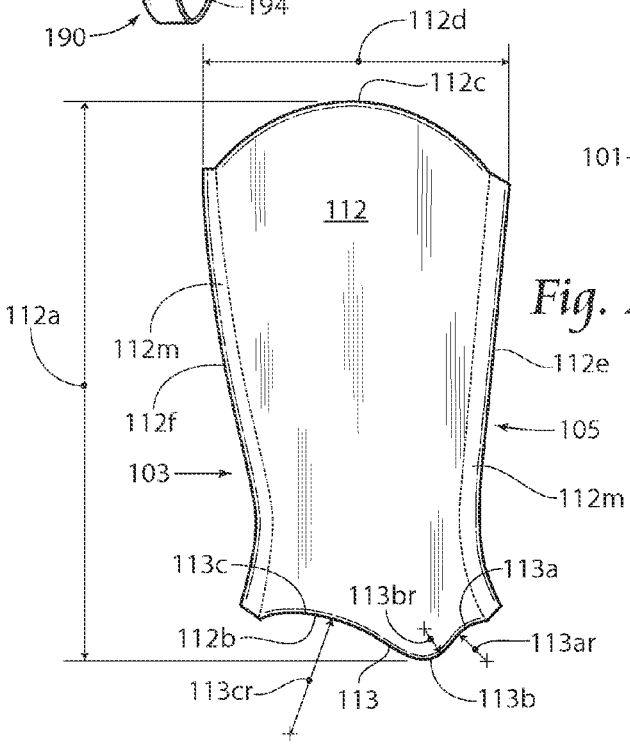
FIG. 2A is a side elevation view of a left side panel of the embodiment of FIG. 1.

This preferred embodiment 100 is generally formed as a tubular structure including at least one panel 110, but preferably three panels 110. The tubular structure extends longitudinally from an open bottom end 101 to an open top end 102 and circumferentially generally through a back side 103, left side 104, front side 105, and right side 106. A left panel 112, a right panel 114 and a top panel 116, all of which may be the same material (e.g. leather) or different material, are secured together, such as by stitching 118. FIG. 2A is a side elevation view of the left panel 112. The left panel 112 is generally a panel cut or otherwise formed from flexible material (e.g. leather), which extends along a length 112*a* between a bottom end 112*b* and a top end 112*c*, and along a width 112*d* (measured perpendicular to the length 112*a*) between a front side 112*e* and a rear side 112*f*. While any functional shape may be used, the bottom end 112*b* is preferably cut along a serpentine edge 113 having one or more curves, in this case, a first curve 113*a*, a second curve 113*b*, and a third curve 113*c*. The first curve 113*a* extends inward towards the top end 112*c* at a first radius 113*ar*. The second curve 113*b* extends outward away from the top end 112*c* at a second radius 113*br*. The third curve 113*c* extends inward towards the top end 112*c* at a third radius 113*cr*. The first curve 113*a* is located along the edge 113, preferably closer to the front side 112*e* than the rear side 112*f*. The third curve 113*c* is located along the edge 113, preferably closer to the rear side 112*f* than the front side 112*e*. The second curve 113*b* is located along the edge 113, preferably between the first curve 113*a* and the third curve 113*c*. While the first radius 113*ar* and second radius 113*br* may be similar (second radius 113*br* may be about 70% of the first radius 113*ar*), the third radius 113*cr* is preferably substantially larger, e.g. about 300% to about 400% of the first radius 113*ar*, and about 400% to about 500% of the second radius 113*br*.

The to end 112*c* may be formed in any desired shape, such as substantially outwardly curved as shown. The front side 112*e* and the rear side 112*f* are preferably at least substantially identical mirror images, including a margin 112*m* extending therealong, the margins 112*m* being suitable for fastening the panel 112 to other clothing panels (e.g. the right panel 114) or to fastening members 190 such as the zipper 192. The front side 112*e* and rear side 112*f* preferably taper inwardly from the top end 112*c* towards the bottom end 112*b*, and from the bottom end 112*b* towards the top end 112*c*, the tapers generally meeting at a narrowest width 112*d* located closer to the bottom end 112*b* than the top end 112*c*.

Figure 2B:
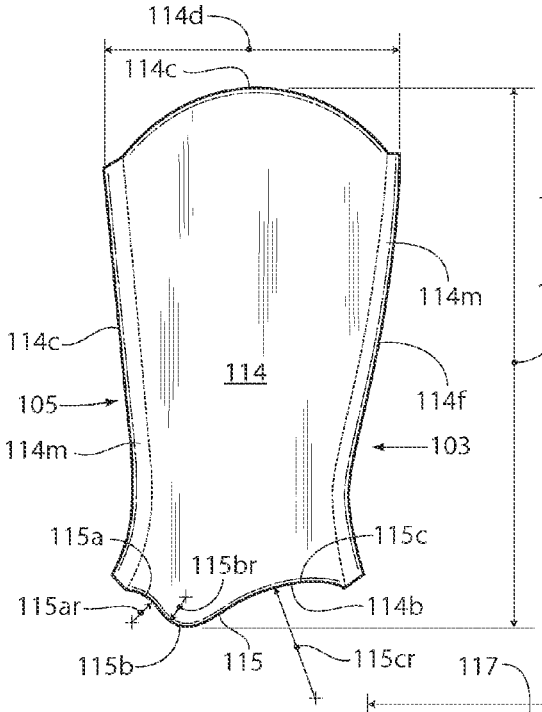
FIG. 2B is a side elevation view of a right side panel of the embodiment of FIG. 1.

FIG. 2B is a side elevation view of the right panel 114, which is preferably at least substantially a mirror image of the left panel 112. The right panel 114 is generally a panel cut or otherwise formed from flexible material (e.g. leather), which extends along a length 114*a* between a bottom end 114*b* and a top end 114*c*, and along a width 114*d* (measured perpendicular to the length 114*a*) between a front side 114*e* and a rear side 114*f*. While any functional shape may be used, the bottom end 114*b* is preferably cut along a serpentine edge 115 having one or more curves, in this case, a first curve 115*a*, a second curve 115*b*, and a third curve 115*c*. The first curve 115*a* extends inward towards the top end 114*c* at a first radius 115*ar*. The second curve 115*b* extends outward away from the top end 114*c* at a second radius 115*br*. The third curve 115*c* extends inward towards the top end 114*c* at a third radius 115*cr*. The first curve 115*a* is located along the edge 115, preferably closer to the front side 114*e* than the rear side 114*f*. The third curve 115*c* is located along the edge 115, preferably closer to the rear side 114*f* than the front side 114*e*. The second curve 115*b* is located along the edge 115, preferably between the first curve 115*a* and the third curve 115*c*. While the first radius 115*ar* and second radius 115*br* may be similar (second radius 115*br* may be about 70% of the first radius 115*ar*), the third radius 115*cr* is preferably substantially larger, e.g. about 300% to about 400% of the first radius 115*ar*, and/or about 400% to about 500% of the second radius 115*br*.

The top end 114*c* may be formed in any desired shape, such as substantially outwardly curved as shown. The front side 114*e* and the rear side 114*f* are preferably at least substantially identical mirror images, including a margin 114*m* extending therealong, the margins 114*m* being suitable for fastening the panel 114 to other clothing panels (e.g. the left panel 112) or to fastening members 190 such as the zipper 192. The front side 114*e* and rear side 114*f* preferably taper inwardly from the top end 114*c* towards the bottom end 114*b*, and from the bottom end 114*b* towards the top end 114*c*, the tapers generally meeting at a narrowest width 114*d* located closer to the bottom end 114*b* than the top end 114*c*.

Figure 2C:
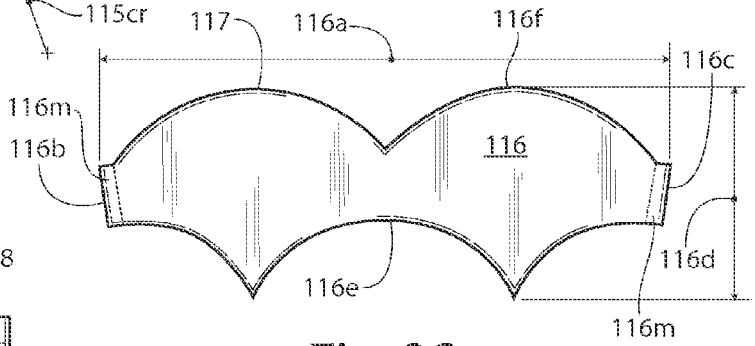
FIG. 2C is a side elevation view of a top panel of the embodiment of FIG. 1.

FIG. 2C shows an embodiment of a top panel 116 according to the present invention. The top panel 116 is generally a panel cut or otherwise formed from flexible material (e.g. leather), which extends along a length 116*a* between a left end 116*b* and a right end 116*c*, and along a width 116*d* (measured perpendicular to the length 116*a*) between a bottom end 116*e* and a top end 116*f*. The length 116*a* is substantially equal to the sum of the left panel width 112*a* and the right panel width 114*a* at the top of the margins 112*m*,114*m* provided thereon. While any shape may be used, the top end 116*f* is preferably cut along an edge 117 that at least substantially matches the top ends 112*c*,114*c* of the left panel 112 and right panel 114 respectively.

The bottom end 116*e* may be formed in any desired shape, such as having two symmetric peaks, as shown. The left side 116*b* and the right side 116*c* are preferably at least substantially identical mirror images, including a margin 116*m* extending therealong, the margins 116*m* being suitable for fastening the member 190 to other clothing panels (e.g. the left panel 112 and/or right panel 114) or to fastening members 190 such as the zipper 192.

Figure 2D:
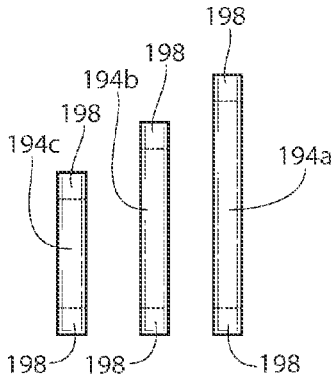
FIG. 2D is a side elevation view of a plurality of straps, one of which is in use on the embodiment of FIG. 1.

FIG. 2D shows a plurality of fastening members 190 in the form of straps 194 of various lengths. Each strap 194 may be provided with a margin 198 extending from one or both ends of the strap 194, the margin 198 being adapted to be attached to the left panel 112, the right panel 114, or both, such as by being sewn or snapped thereto.

Figure 2E:
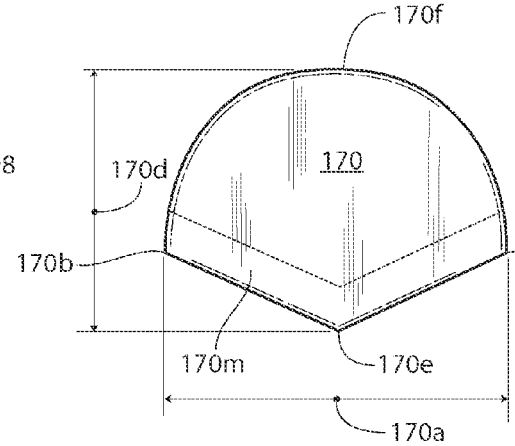
FIG. 2E is a side elevation view of a first embodiment of a knee cap panel according to the present invention.
Figure 3:
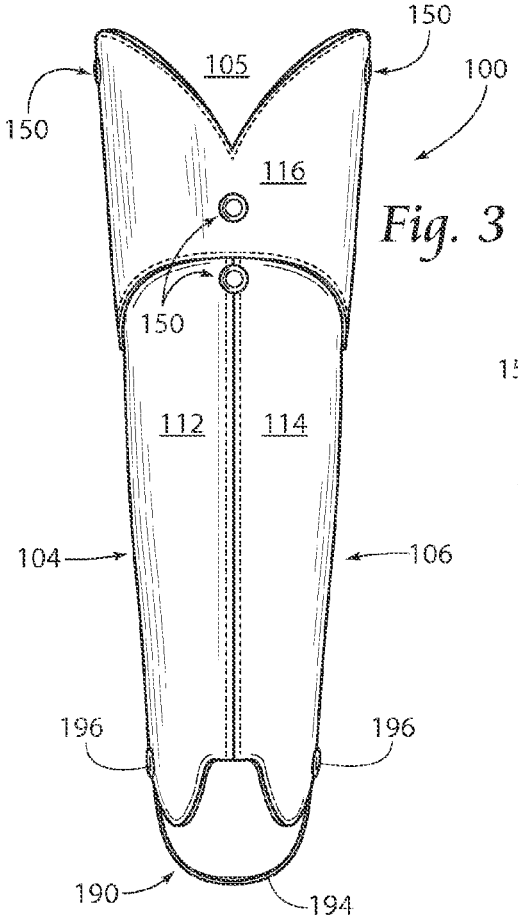
FIG. 3 is a front side elevation view of the embodiment of FIG. 1.
Figure 4:
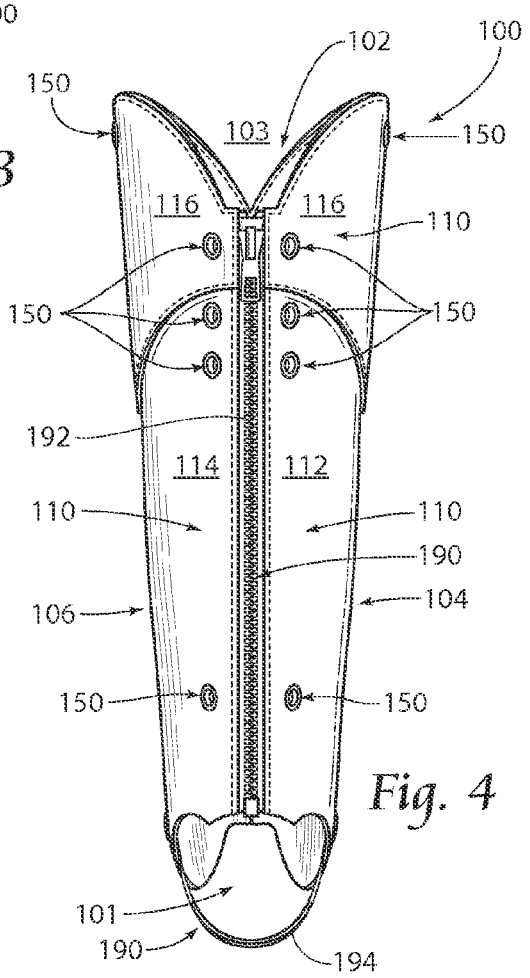
FIG. 4 is a rear side elevation view of the embodiment of FIG. 1.
Figure 5:
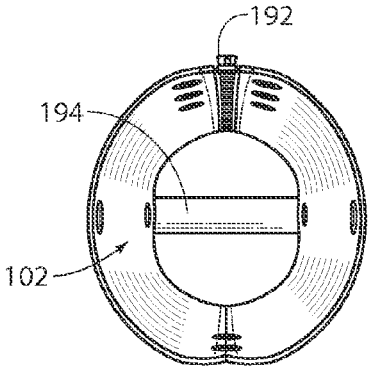
FIG. 5 is a top plan view of the embodiment of FIG. 1.
Figure 6:
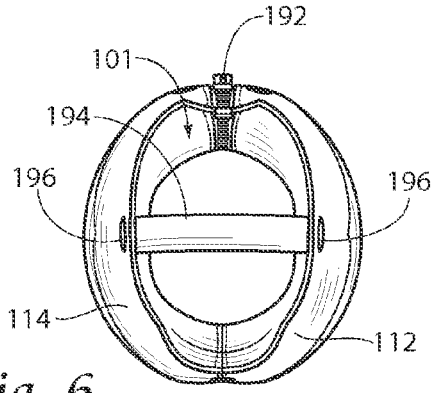
FIG. 6 is a bottom plan view of the embodiment of FIG. 1.
Figure 7:
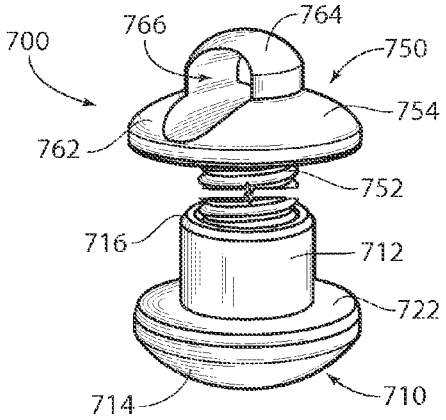
FIG. 7 is a perspective view of a first embodiment of an anchor fastener according to the present invention.
Figure 8:
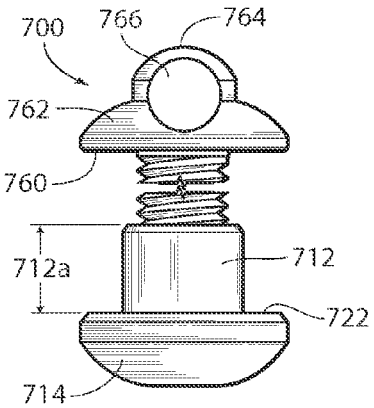
FIG. 8 is a left side elevation view of the embodiment of FIG. 7, to which the right side elevation view is identical.
Figure 9A:
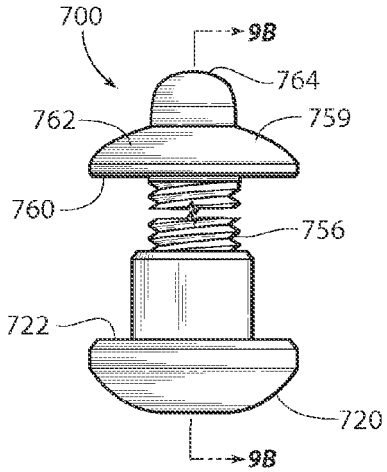
FIG. 9A is a front side elevation view of the embodiment of FIG. 7, to which the rear side elevation view is identical.
Figure 9B:
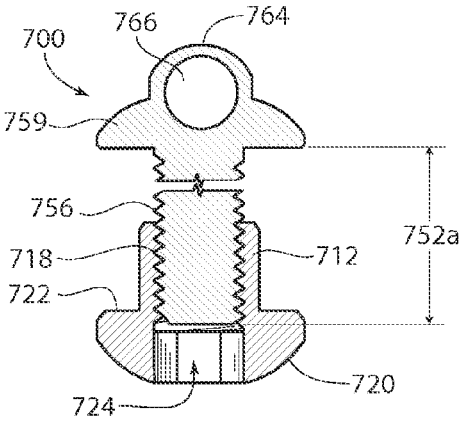
FIG. 9B is a cross-section view taken along lines 9B-9B of FIG. 9A.
Figure 10:
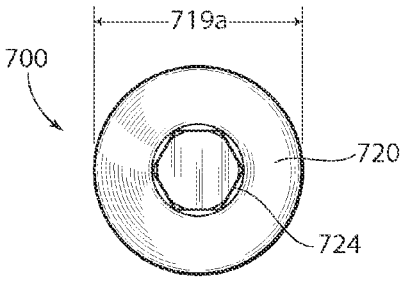
FIG. 10 is a bottom plan view of the embodiment of FIG. 7.
Figure 11:
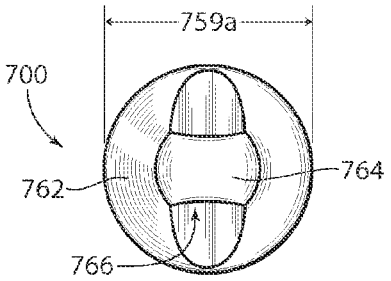
FIG. 11 is a top plan view of the embodiment of FIG. 7.

FIG. 2E depicts a knee cap panel 170 according to the present invention. The knee cap panel 170 is generally a panel cut or otherwise formed from flexible material (e.g. leather), which extends along a length 170*a* between a left end 170*b* and a right end 170*c*, and along a width 170*d* (measured perpendicular to the length 170*a*) between a bottom end 170*e* and a top end 170*f*. The length 170*a* is preferably greater than the sum of one-half of the left panel width 112*a* and one-half of the right panel width 114*a* at the top of the margins 112*m*, 114*m* provided thereon. While any shape may be used, the top end 170*f* is preferably cut along a curved edge 172.

The bottom end 170*e* is preferably formed in a symmetric V-shape, as shown, including a margin 170*m* extending therealong, the margin 170*m* being suitable for fastening the panel 170 to other clothing panels (e.g. the left panel 112 and/or right panel 114), such as by being sewn thereto, or coupled at one or more anchor points 150.

FIGS. 3-6 show indicated views of the first embodiment 100.

FIGS. 7-11 provide a first embodiment 700 of a fastener according to the present invention. The fastener 700 is adapted to be positionable at a desired anchor point 150 provided on a clothing article. The anchor point 150 preferably includes at least a throughhole 152 formed in one of the panels 110, and may further include a reinforcement member, such as a grommet 154. The fastener 700 generally includes a back member 710 and a front member 750. The back member 710 includes a stem 712 and a cap 714. The stem 712 is generally a hollow, cylindrical member extending along a length 712*a* between two open ends. The cap 714 is attached, preferably symmetrically, at one of the open ends. The other open end may include a circumferential taper 716 that may assist in inserting the stem 710 into an anchor point 150, such as through a grommet 154. An inside surface of the stem 752 is preferably provided with threads 718 to cooperate with the front member 750. The cap 714 is generally provided as a rounded head 719 extending between a rear surface 720 and a front surface 722 and having a diameter 719*a*. The rear surface 720 is preferably partially frustospherical or at least partially domed and has a bore 724 formed therethrough, which is preferably coaxial with the stem 712. The bore 724 may be formed as a hexagonal hole which may accommodate a conventional hex, or Allen, wrench. Additionally or alternatively, a slot (not shown) may be provided on the rear surface 720 to accept a conventional flathead screwdriver. The front surface 722 is preferably a planar surface annularly disposed about the stem 712, and may extend perpendicularly therefrom. The length 712*a* of the stem 712, as measured from the front surface 722 of the cap 714 is preferably shorter than a thickness of panel material and/or grommet 154 provided at an anchor point 150. This arrangement may be advantageous if static rotational placement of the front member 750 is desired. Alternatively, the length 712*a* of the stem 712, as measured from the front surface 722 of the cap 714 may be longer than the thickness of panel material and/or grommet 154 provided at an anchor point 150 if rotational movement of the front member 750 is desired, even when secured tightly to the back member 710.

The front member 750 includes a stem 752 and a cap 754. The stem 752 is generally a solid, cylindrical member extending along a length 752*a*. The cap 754 is attached, preferably symmetrically, at one end of the stem 752. An outside surface of the stem 752 is preferably provided with threads 756 to cooperate with the back member 710. The cap 754 is generally provided as a rounded head 759 extending between a rear surface 760 and a front surface 762 and having a diameter 759*a*. The back surface 760 is preferably a planar surface annularly disposed about the stem 752, and may extend perpendicularly therefrom. The length 752*a* of the stem 752, as measured from the back surface 760 of the cap 754 is preferably shorter than a thickness of panel material and/or grommet 154 provided at an anchor point 150. The front surface 762 is preferably partially frustospherical or at least partially domed and has a nipple 764 formed thereon, which is preferably coaxial with the stem 752. Extending at least partially through the nipple 764 is at least one receiving aperture 766, preferably formed perpendicularly to the stem 752. The aperture 766 is sized and configured to receive one or more clips, as described below.

Figure 12:
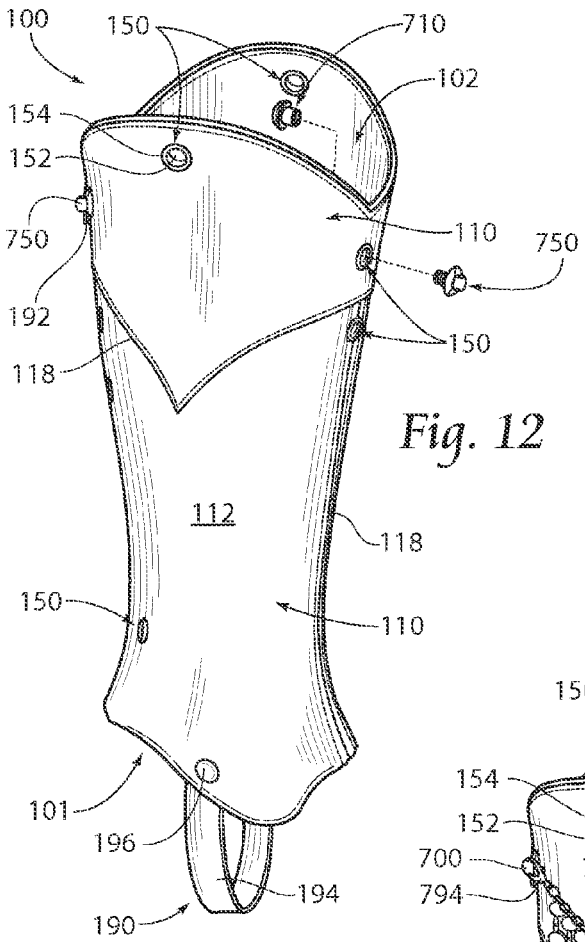
FIG. 12 is a perspective view of the embodiment of FIG. 1, further receiving an anchor fastener of FIG. 7.
Figure 13:
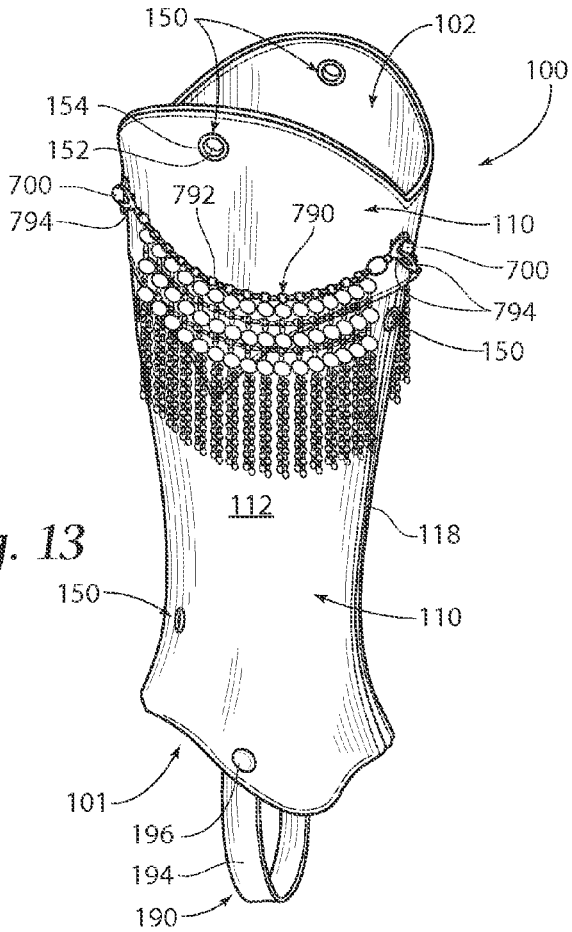
FIG. 13 is a perspective view of a first adorned embodiment of the clothing article of FIG. 1.
Figure 14:
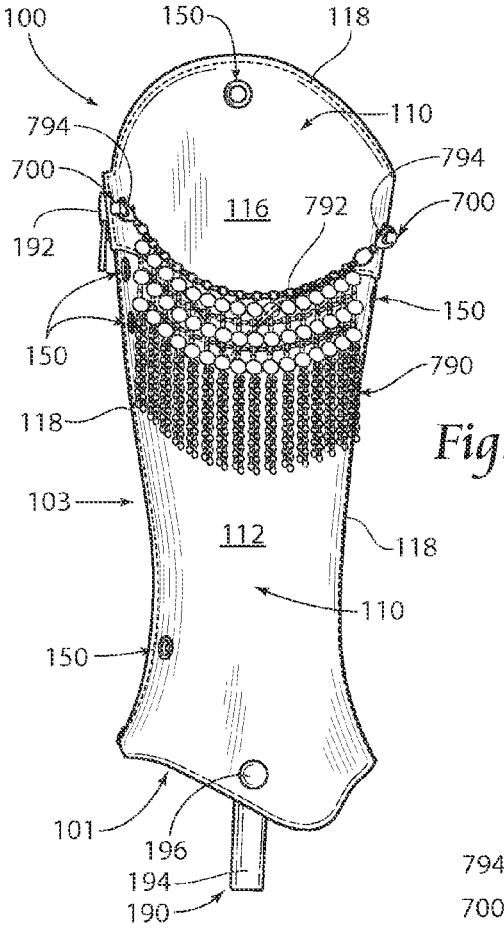
FIG. 14 is a left side elevation view of the embodiment of FIG. 13.
Figure 15:
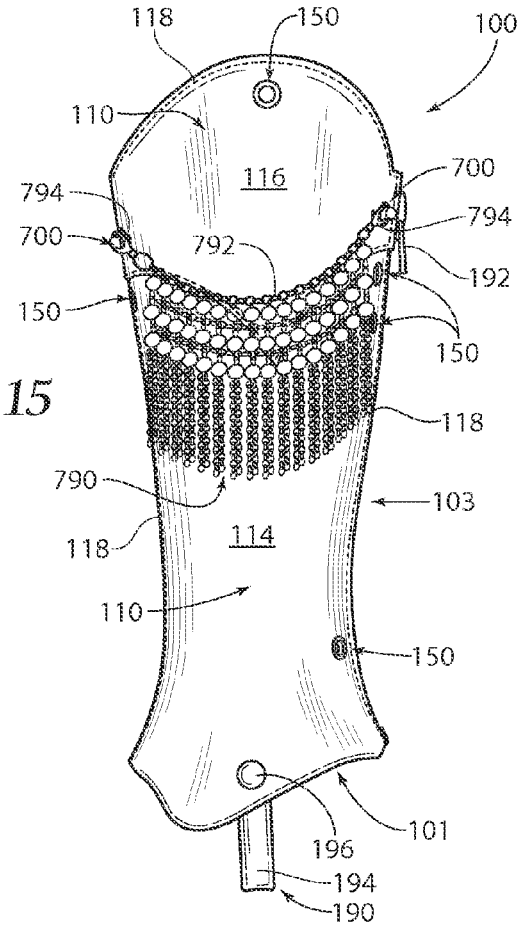
FIG. 15 is a right side elevation view of the embodiment of FIG. 13.
Figure 16:
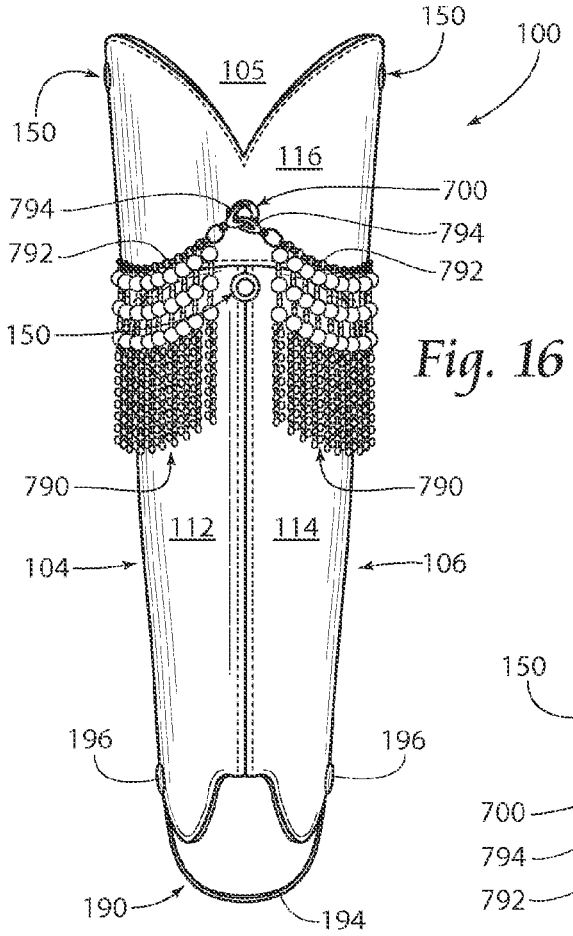
FIG. 16 is a front side elevation view of the embodiment of FIG. 13.
Figure 17:
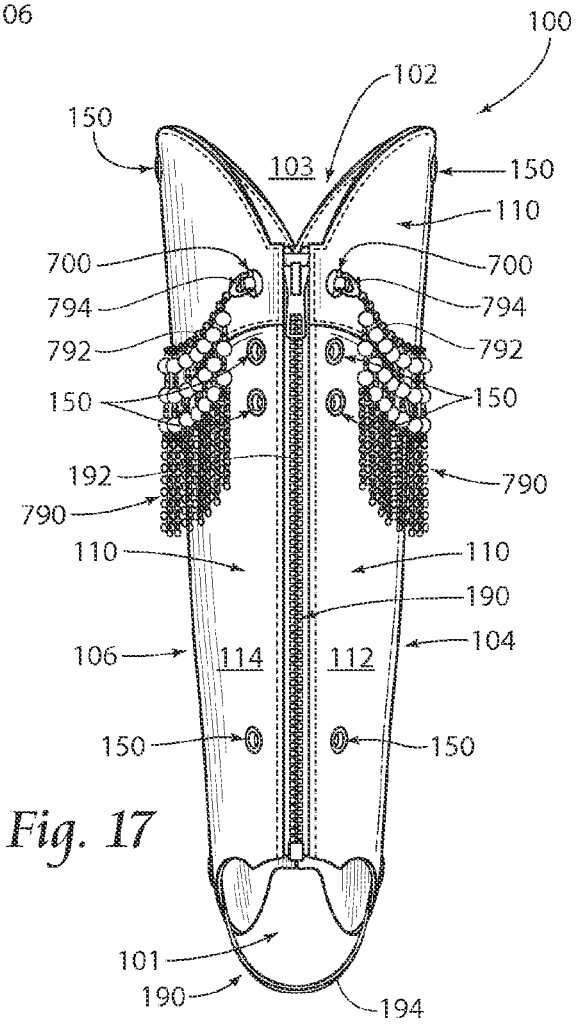
FIG. 17 is a rear side elevation view of the embodiment of FIG. 13.

FIG. 12 shows a fastener 700 being inserted into an anchor point 150 on the clothing article 100 previously described. The back member 710 can be threadingly engaged with the front member 750, and the fastener 700 may be supported by the anchor point 150.

Figure 18:
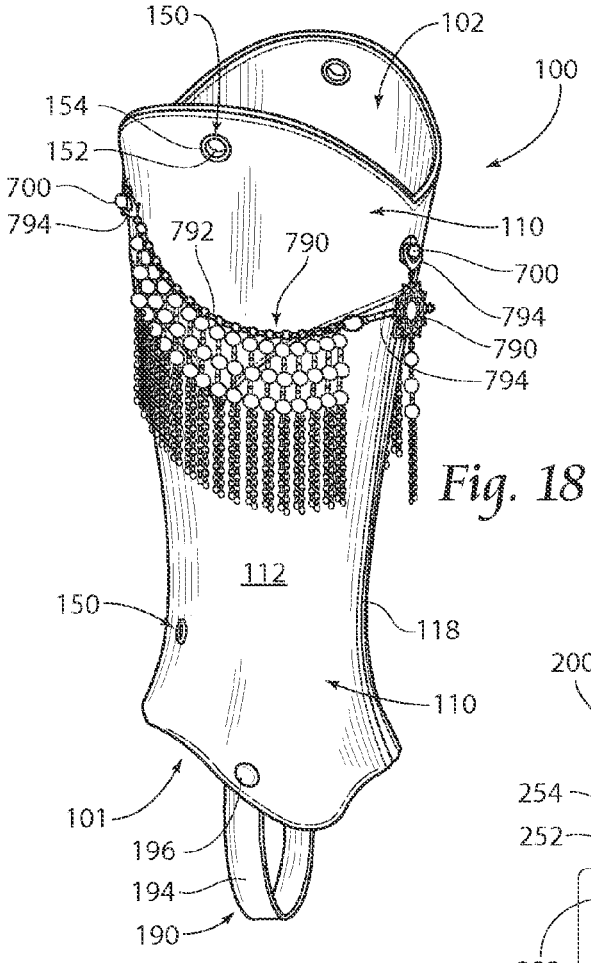
FIG. 18 is a perspective view of a second adorned embodiment of the clothing article of FIG. 1.

FIGS. 13-17 show an adorned version of a clothing article according to the present invention. This adorned embodiment includes a plurality of anchor points 150, some having received a fastener 700 therein. Extended between a plurality of the anchor points 150 is at least one decorative element 790, such as a decorative chain 792, which includes a jeweler's clip 794 on at least one end thereof. The jeweler's clip 794, as is known, generally includes a spring biased clasp that can be inserted into the receiving aperture 766 of the fastener 700 and, thus, supported by the fastener 700 and/or clothing panel 110. Additionally or alternatively, a second jeweler's clip 794 may be supported by a first jeweler's clip 794, the first jeweler's clip 794 being supported on a fastener 700. In this manner, a decorative element 790 may be directly (or indirectly through additional decorative elements as shown in FIG. 18) supported by one or more anchor points 150 provided on a clothing article 100. The adorned embodiment shown in FIGS. 13-17 includes a decorative element 790 provided on each of the left side 104 and the right side 106, it is to be understood that a decorative element 790 may be provided on only a single side, or such element may span multiple clothing panels 110.

Figure 19:
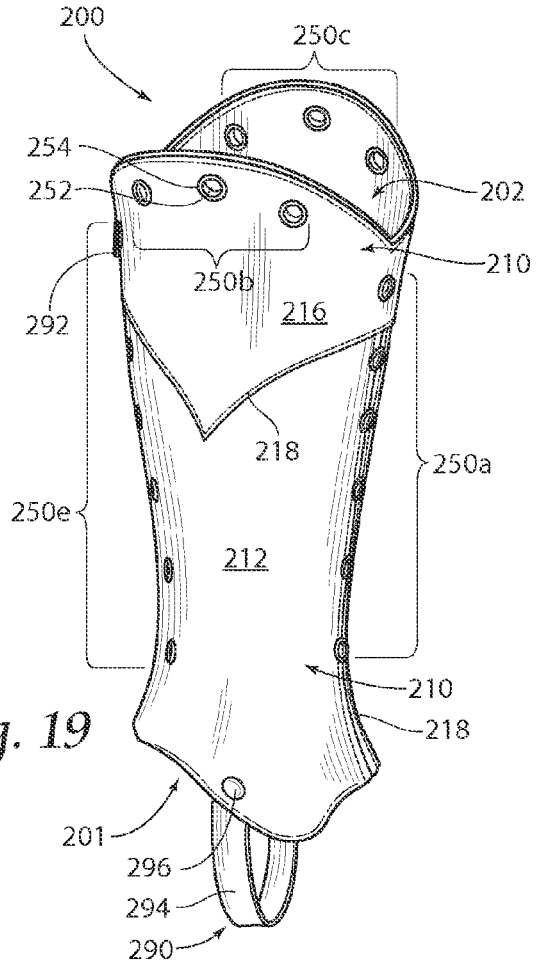
FIG. 19 is a perspective view of a second embodiment of selectively decorative clothing according to the present invention.
Figure 20A:
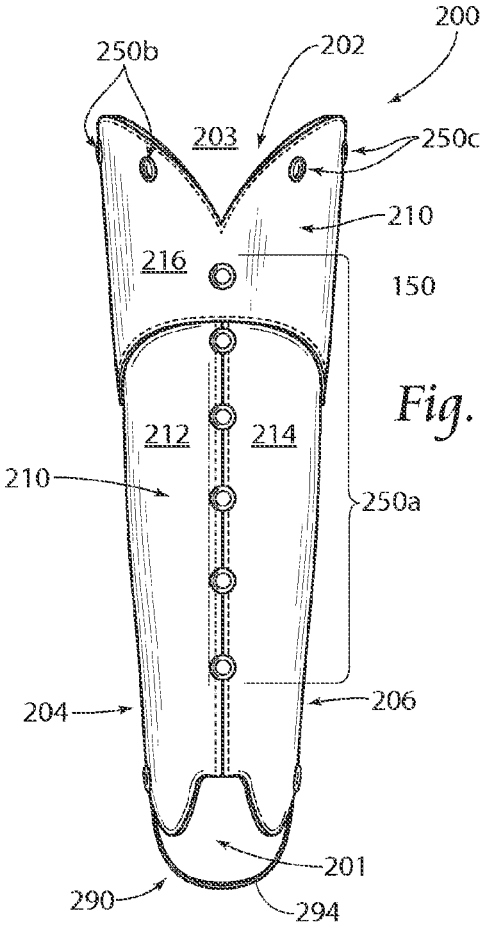
FIG. 20A is a front side elevation view of the embodiment of FIG. 19.
Figure 20B:
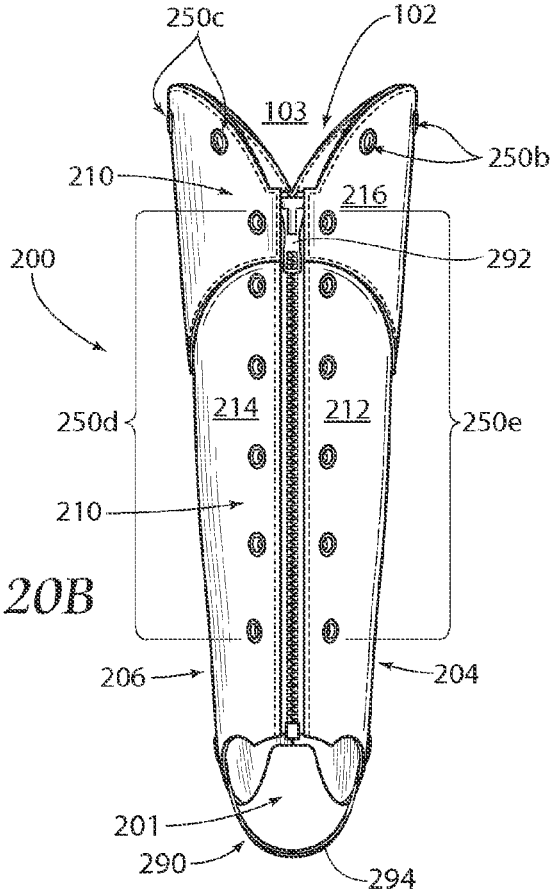
FIG. 20B is a rear side elevation view of the embodiment of FIG. 19.

FIGS. 19-20B provide a second embodiment 200 of a clothing article according to the present invention, wherein like reference numerals refer to similar or identical structure as provided in the first embodiment 100. In this embodiment 200, one or more of anchor points 250 are provided along a perimeter of a clothing panel 210. That is, a first group 250*a* may be provided along the front side of the article 200. A second group 250*b* may be provided along the top end of the left panel 212. A third group 250*c* may be provided along the top end of the right panel 214. A fourth group 250*d* may be provided along the rear side of the right panel 214. A fifth group 250*e* may be provided along the rear side of the left panel 212.

Figure 21:
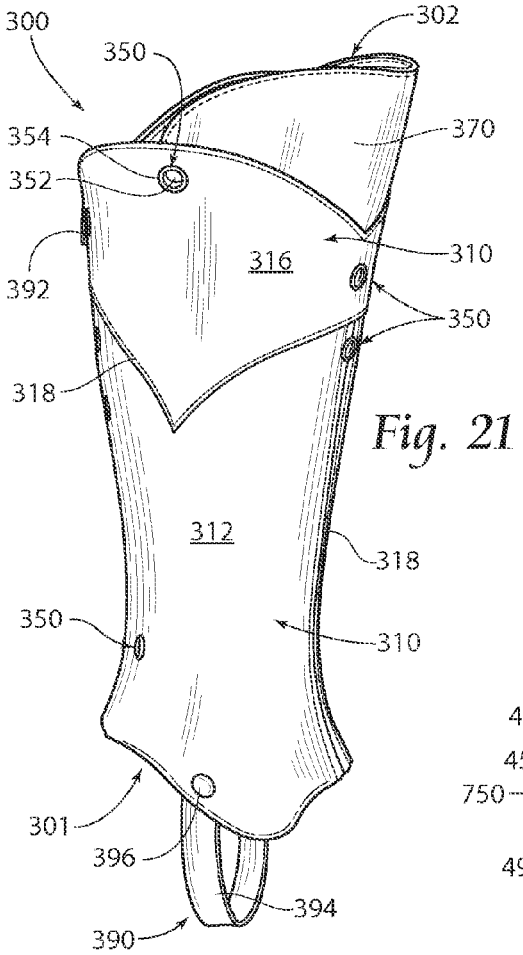
FIG. 21 is a perspective view of a third embodiment of selectively decorative clothing according to the present invention.

FIG. 21 provides a third embodiment 300 of a clothing article according to the present invention, wherein like reference numerals refer to similar or identical structure as provided in the first embodiment 100. This embodiment 300 includes the first embodiment 100 with an added knee cap 370, which is of substantially the same construction as the knee cap panel 170 previously described, and is sewn to the to panel 316 and the side panels 312,314.

Figure 22:
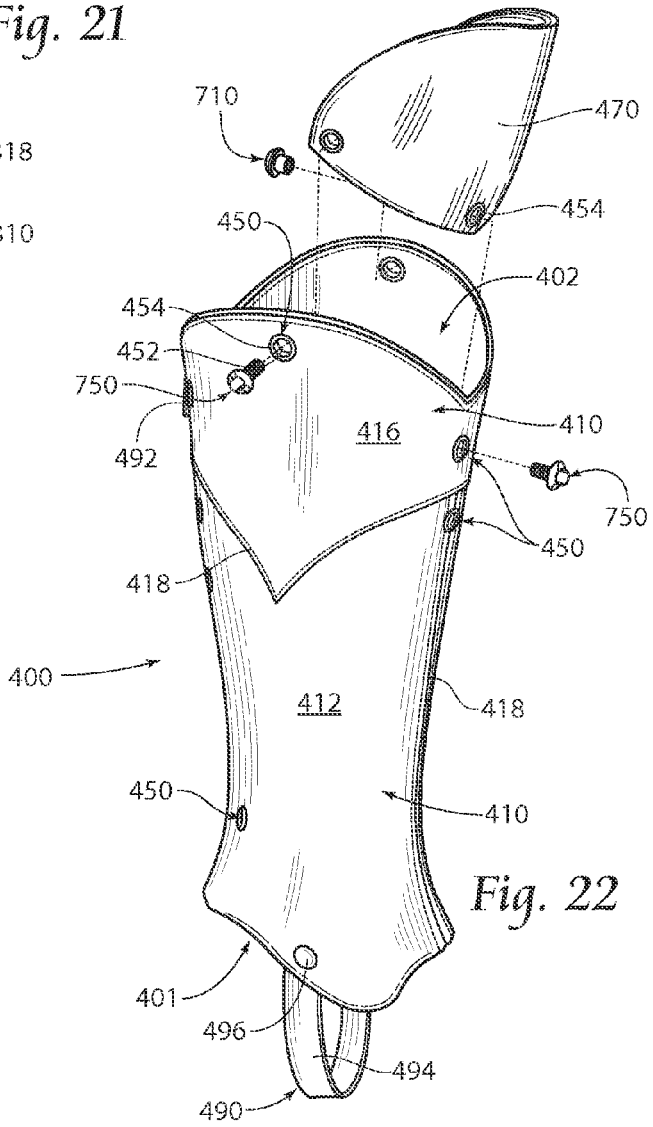
FIG. 22 is a perspective view of a fourth embodiment of selectively decorative clothing according to the present invention.

FIG. 22 depicts a fourth embodiment 400 of a clothing article according to the present invention, wherein like reference numerals refer to similar or identical structure as provided in the first embodiment 100. This embodiment 400 includes the first embodiment 100 with an added knee cap 470, which is of substantially the same construction as the knee cap panel 170 previously described, but having grommets 454 arranged to mate with anchor points 150 on the first embodiment 100. In this manner, the knee cap 470 is selectively supportable by the article 100 and selectively removable therefrom.

Figure 23:
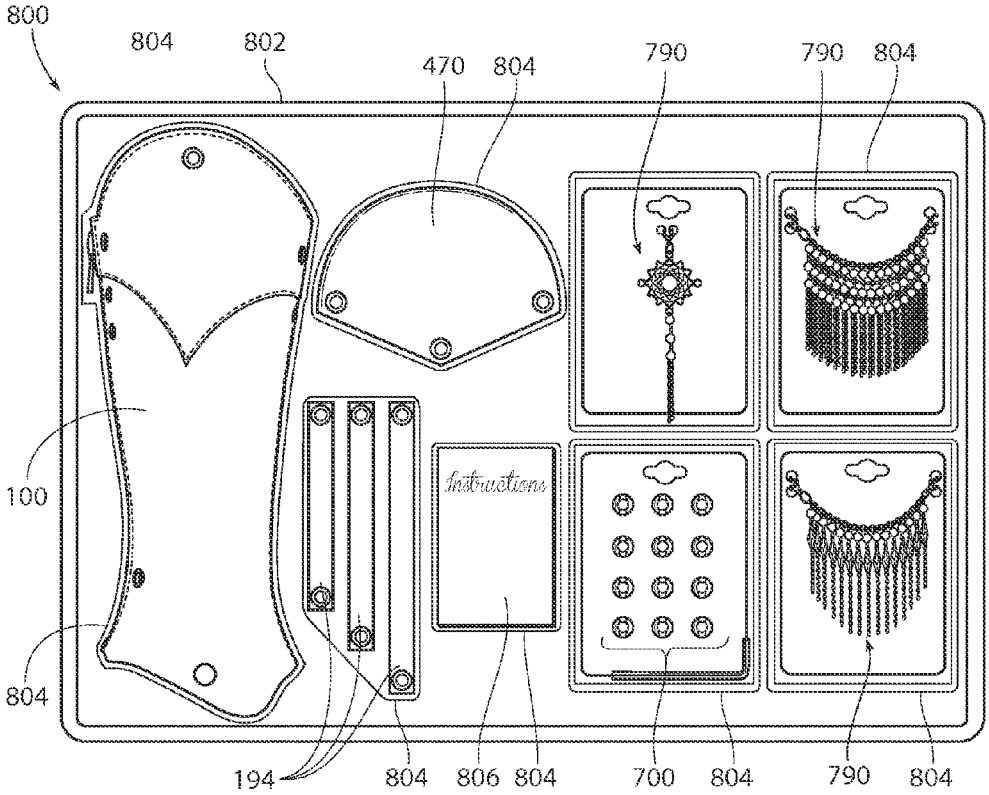
FIG. 23 is a top plan view of a first embodiment of a kit according to the present invention.
Figure 24:
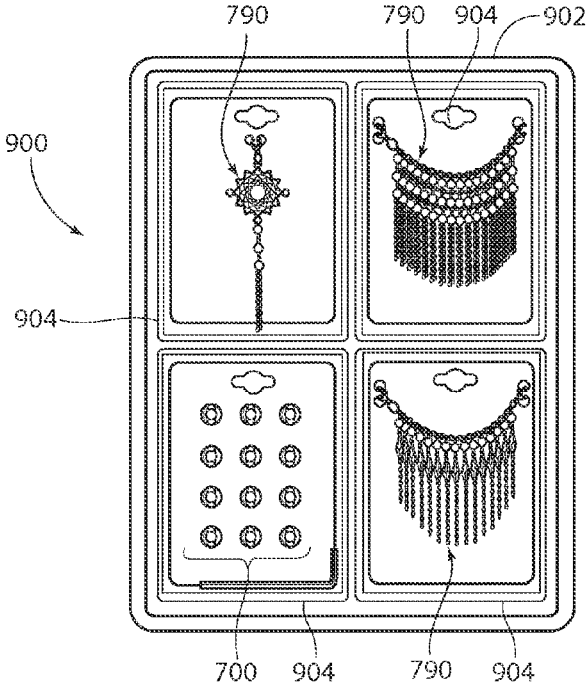
FIG. 24 is a top plan view of a second embodiment of a kit according to the present invention.

FIGS. 23 and 24 show examples of kits according to the present invention. In a first kit 800, as shown in FIG. 23, packaged together (possibly in a vacuum formed tray 802 having one or more cavities 804 formed therein) may be one or more of the following: one or more clothing articles 100, one or more knee cap panels 470 (preferably the same number as the number of clothing articles 100), one or more decorative elements 790, one or more fasteners 700, and instructions 806. In a preferred kit 800 are provided at least two clothing articles 100, six fasteners 700, and three pairs of heel straps 194, each pair preferably a different length than the other two pairs. The kit 800 may further include two or four decorative elements 790, and up to twelve or more fasteners 700, and may optionally include instructions 806. Another preferred kit 900, as shown in FIG. 24, does not include a clothing article 100, but rather includes one or more decorative elements 790 and/or one or more fasteners 700.

Figure 25:
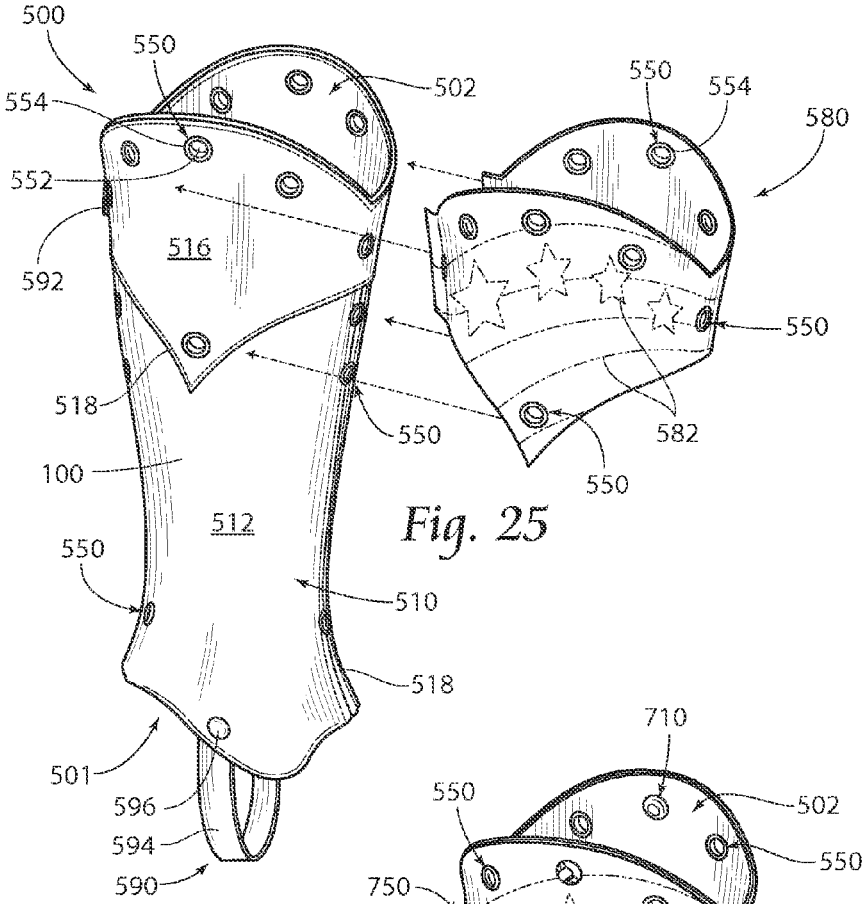
FIG. 25 is a perspective view of a fifth embodiment of selectively decorative clothing according to the present invention.
Figure 26:
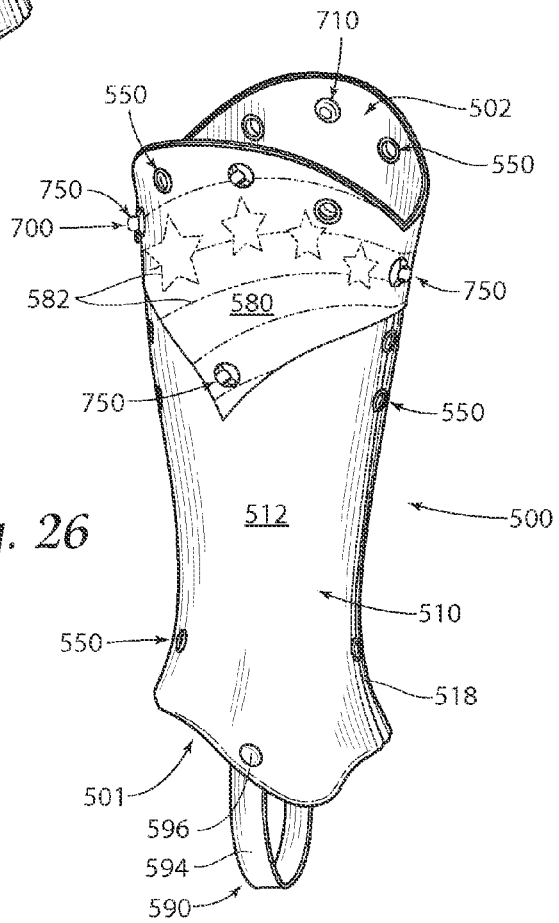
FIG. 26 is a perspective view of the fifth embodiment shown in FIG. 25.

FIGS. 25 and 26 depict a fifth embodiment 500 of a clothing article according to the present invention, wherein like reference numerals refer to similar or identical structure as provided in the first embodiment 100. This embodiment 500 includes an embodiment of a selectively decorative clothing article according to the present invention, such as the first embodiment 100, further including a shin wrap panel 580 which preferably of substantially the same construction as the top panel 116 previously described, but having at least two anchor points 550, which may include grommets 554, arranged to mate with anchor points 150 on the article 100. In this manner, the shin wrap panel 580 is selectively supportable on the article 100, such as by using one or more fasteners 700, and selectively removable thereform.

Additionally or alternatively, the shin wrap panel 580 may be of a different color or material than the left panel 112, right panel 114, or the top panel 116 and may include indicia 582 emblazoned thereupon.

A method according to the present invention includes steps of coupling a decorative element to an anchor point on a clothing article and decoupling the decorative element from the anchor point without destruction of the clothing article or the decorative element. A method according to the present invention may additionally or alternatively include the steps of coupling a plurality of decorative elements to a plurality of anchor points provided on a clothing article. A method according to the present invention may additionally include the step of donning the clothing article on an animal body, such as a body of a human or domesticated pet. The step of coupling and/or decoupling a decorative element may be performed after or before the donning step. A method according to the present invention may additionally include the step of supporting at least one fastener on the clothing article and supporting the decorative element on at least one of the fasteners.

The foregoing is considered as illustrative only of the principles of the invention. Furthermore, since numerous modifications and changes will readily occur to those skilled in the art, it is not desired to limit the invention to the exact construction and operation shown and described. For instance, embodiments of articles falling within the scope of the present invention may include other types of clothing articles or accessories, such as jackets, head bands, skirts, pants, shorts, belts, vests, bustiers, brasseres, boots, wrist cuffs, arm cuffs, neck collars, purses, wallets, etc., whether worn by a human or another animal. While the preferred embodiment has been described, the details may be changed without departing from the invention, which is defined by the claims.

I claim:

1. A selectively decorative clothing article comprising:

a left panel having a left panel top end, a left panel front side, and a left panel rear side;

a right panel having a right panel top end, a right panel front side, and a right panel rear side;

a top panel having a top panel top end and a top panel bottom end;

the left panel front side attached to the right panel front side and the left panel rear side coupled to the right panel rear side;

the top panel top end attached to the left panel top end and the right panel top end;

a first fastening member configured to selectively couple the left panel to the right panel;

an anchor point comprising a hole, the anchor point being supported by at least one of the left panel, the right panel, and the top panel; and a fastener comprising a fastener back member reversibly mateable with a fastener front member, the fastener configured to be received within the anchor point hole.

2. The selectively decorative clothing article of claim 1, wherein the left and right panels are substantially mirror images of each other.

3. The selectively decorative clothing article of claim 1, wherein the first fastening member is a strap.

4. The selectively decorative clothing article of claim 3, further including a second fastening member coupling the left panel to the right panel, the second fastening member comprising a zipper.

5. The selectively decorative clothing article of claim 1, wherein the first fastening member is a zipper.

6. The selectively decorative clothing article of claim 1 further comprising a knee cap panel coupled to and extending from the top panel top end.

7. The selectively decorative clothing article of claim 6, the anchor point being supported by the top panel and the knee cap panel being selectively attachable to and removable from the top panel by the fastener received within the anchor point.

8. The decorative clothing article of claim 1, wherein the fastener front member further comprises a receiving aperture.

9. The decorative clothing article of claim 8, further comprising a decorative element selectively coupled to the fastener through the receiving aperture.

10. The decorative clothing article of claim 1, further comprising a shin wrap panel selectively supported by the top panel.

11. The decorative clothing article of claim 10, wherein the shin wrap panel and the top panel are substantially similar in shape.

12. A kit comprising:

a package containing a selectively decorative clothing article according to claim 1 and at least one of a knee cap panel and a decorative element.

13. The kit of claim 12, wherein the first fastening member is a heel strap selectively securable to each of the right and left panels.

14. The kit of claim 12, wherein the first fastening member comprises a zipper.

15. The kit of claim 12, further comprising a shin wrap panel configured to be selectively supported by, and substantially similar in shape to, the top panel.

16. The kit of claim 12, further comprising one or more additional fasteners, wherein the additional fasteners are substantially identical to the fastener.

17. A method of coupling a decorative element to an anchor point on a clothing article, the method comprising the steps of:

providing a clothing article having an anchor point formed in and supported by a panel of material;

providing a fastener to be received by the anchor point, the fastener comprising a receiving aperture;

providing a decorative element comprising a first jeweler's hook;

securing the fastener to the anchor point;

coupling the first jeweler's hook to the fastener by inserting the hook through the receiving aperture; wherein the clothing article comprises: a left panel having a left panel top end, a left panel front side, and a left panel rear side;

a right panel having a right panel top end, a right panel front side and a right panel rear side;

a top panel having a top panel bottom end and a top panel top end, wherein the panel of material is one of the left panel, the right panel and the top panel, and wherein the left panel front side is coupled to the right panel front side and the left panel rear side is coupled to the right panel rear side, the top panel bottom end is coupled to the left panel top end and the right panel top end, and a fastening member is coupled to each of the left panel and the right panel.

18. The method of claim 17, wherein the clothing article further comprises N number of additional anchor points formed in one or more of the left panel, right panel and top panel, and wherein the decorative element comprises a second jeweler's hook, the method further comprising the steps of:

providing M number of additional fasteners, wherein the additional fasteners are substantially identical to the fastener;

securing a second fastener to one of the additional anchor points, the second fastener being one of the additional fasteners; and coupling the second jeweler's hook to the second fastener by inserting the hook through the receiving aperture of the second fastener.

19. The method of claim 18, wherein N is greater than M.

20. The method of claim 18, further comprising the steps of:

providing a shin wrap panel comprising at least two shin wrap anchor points;

aligning the shin wrap anchor points with the anchor point and at least one additional anchor point; and supporting one of the fastener and the M additional fasteners in each of the anchor points.

* * * * *